US005436074A

United States Patent [19]

Shimura et al.

[11] Patent Number: 5,436,074

[45] Date of Patent: Jul. 25, 1995

[54] POLYPROPYLENE HIGHLY SPREAD PLEXIFILAMENTARY FIBER

[75] Inventors: Kazuhiko Shimura; Yoshiaki Nakayama, both of Nobeoka, Japan

[73] Assignee: Asahi Kasei Kogyo Kabushiki Kaisha, Osaka, Japan

[21] Appl. No.: 982,055

[22] Filed: Nov. 25, 1992

Related U.S. Application Data

[63] Continuation of Ser. No. 800,715, Dec. 3, 1991, abandoned, which is a continuation of Ser. No. 549,314, Jul. 9, 1990, abandoned.

[30] Foreign Application Priority Data

Jul. 12, 1989 [JP] Japan ..... 1-178097
Jul. 28, 1989 [JP] Japan ..... 1-194374
Aug. 8, 1989 [JP] Japan ..... 1-203864

[51] Int. Cl.[6] ..... D01F 6/00

[52] U.S. Cl. ..... 428/369; 428/357; 428/364; 428/400; 428/397; 264/205; 162/157.5; 525/333.8; 528/491; 528/502

[58] Field of Search ..... 428/357, 364, 369, 400; 264/205; 162/157.5; 525/333.8; 528/491, 502

[56] References Cited

U.S. PATENT DOCUMENTS 3,564,088 2/1971 Woodell ..... 264/205
3,641,760 2/1972 Keuchel ..... 264/147 X
3,756,441 9/1973 Anderson et al. ..... 264/205
4,183,881 1/1980 Griffin et al. ..... 264/13

FOREIGN PATENT DOCUMENTS 62-33816 10/1988 Japan .
88-10330 6/1990 WIPO .

OTHER PUBLICATIONS

Encyclopedia of Polymer Science and Engineering, vol. 15, pp. 347–348 John Wiley & Sons, New York (1988).

*Primary Examiner*—George F. Lesmes
*Assistant Examiner*—Kathleen L. Choi
*Attorney, Agent, or Firm*—Finnegan, Henderson, Farabow, Garrett & Dunner

[57] ABSTRACT

A polypropylene three-dimensional plexifilamentary fiber having a microwave birefringence of 0.07 or more and an $\overline{M}w/\overline{M}n$ of 4.3 or less. Although a spreading agent is not included in this fiber, the fiber has a superior fiber spreadability and dimensional stability. The fiber in accordance with the present invention can be spun from a dope composed of an isotactic polypropylene having an $\overline{M}w/\overline{M}n$ of 4.3 or less and an MFR of 20 or less, and a halogenated hydrocarbon, by a flash spinning technique. Further, the present invention provides a spinning dope and a method of manufacturing the fiber which effectively prevent ozone layer destruction by using a 2,2-dichloro-1,1,1-trifluoroethane, a 1,2-dichlorotrifluoroethane or a solvent blended a dichloromethane with either of the above two solvents as the halogenated hydrocarbon.

1 Claim, 3 Drawing Sheets

- SOLVENT
  2,2-DICHLORO-111-TRIFLUOROETHANE(DCTFE)
  1,2-DICHLORO-TRIFLUOROETHANE(DCTFE(a))
  TRICHLOROFLUOROMETHANE(TCFM)
- MFR OF POLYMER (RAW MATERIAL): 0.5
- CONCENTRATION OF POLYMER: 10wt%

- SOLVENT BLENDED WITH A DICHLOROMETHANE OF 50 wt% AND 2,2-DICHLORO-1,1,1-TRIFLUOROETHANE OF 50 wt%
- MFR OF POLYMER (IN DOPE): 5.5
- CONCENTRATION OF POLYMER: 10 wt%

POLYPROPYLENE HIGHLY SPREAD PLEXIFILAMENTARY FIBER

This application is a continuation, of application Ser. No. 07/800,715 filed Dec. 3, 1991, which is a continuation of Ser. No. 07/549,314 filed Jul. 9, 1990, both now abandoned.

BACKGROUND OF THE INVENTIONS

1. Field of the Invention

The present invention relates to a polypropylene highly spread plexifilamentary fiber, a dope used for manufacturing the fiber, and a method of manufacturing the fiber. More particularly, the present invention relates to a polypropylene plexifilamentary fiber highly spread to a three-dimensional state and having a high thermal dimensional stability, a dope including a solvent having a weak ozone layer depletion potential and used for manufacturing the fiber, and a method of manufacturing the fiber.

2. Description of the Related Art

A fiber manufactured by a flash spinning technique is known as a fiber fibrillated in a three-dimensional plexifilamentary state. The flash spinning technique is a spinning method in which a uniform solution of a polymer having a fiber-forming ability and a solvent is instantaneously extruded through a spinneret having one or more holes, at a temperature higher than a boiling temperature of the solvent and under a pressure higher than a vapor pressure of the solvent to an area under a lower pressure. The features of the fiber are disclosed in U.S. Pat. No. 3,081,519 and Japanese Examined Patent Application (Kokoku) No. 40-28125.

Namely, the fiber disclosed in U.S. Pat. No. 3,081,519 is a fiber of an organic synthetic crystalline polymer having a surface area of 2 $m^2/g$ or more and a structure in which fibrils are spread in a three-dimensional plexifilamentary state. The fibril has an average thickness of 4 $\mu$ or less and an orientated structure, and is characterized in that an average orientation angle measured by an electron diffraction method is 90° or less. Further this fiber is characterized in that an average orientation angle measured by an X-ray diffraction method is smaller than 55°, and a number of free fibrils is 50/1000 d/0.1 mm or 25/1000 d/0.1 mm, or the like. This three-dimensional plexifilamentary fiber has a non-circular cross section, and a large specific surface area, an excellent light scattering property, a superior bulkiness, and a high strength. Therefore, it is possible to make a nonwoven fabric having a high covering property and a high strength by utilizing the shape and characteristics of this fiber.

After much research, the inventors of the present application have succeeded in the development of a polypropylene three-dimensional plexifilamentary fiber having novel characteristics. The features of this polypropylene plexifilamentary fiber are that this fiber has a microwave birefringence of 0.07 or more, a superior dimensional stability in a heated environment, and a high tensile strength, a high fiber spreadability or the like. In particular, between 0.1 wt % and 10 wt % of a spreading agent is added to this polypropylene plexifilamentary fiber to apply a high fiber spreadability to the fiber, and a nucleating agent, a lubricant or a crystalline resin except a base resin, can be used in this fiber as the spreading agent. This fiber is disclosed in Japanese Unexamined Patent Publications (Kokai) No. 1-104814 and No. 1-132819, and the corresponding PCT application filed as PCT/JP 87-00808.

Known methods of manufacturing a polypropylene three-dimensional plexifilamentary fiber will be described hereafter.

These methods have been disclosed in U.S. Pat. No. 3,467,744, U.S. Pat. No. 3,564,088, U.S. Pat. No. 3,756,441 corresponding to Japanese Unexamined Patent Publication (Kokai) No. 49-42917, and Japanese Unexamined Patent Publication (Kokai) No. 62-33816 filed by the same applicant as that of the present application.

In the above known publications, a dope having an isotactic polypropylene content of between 2 wt % and 20 wt % is prepared by using a solvent, such as a 1,1,2-trichloro-1,2,2-trifluoroethane, a trichloro fluoromethane or the like, a uniform dope is made from the above dope under a pressure of a two-liquid-phase boundary pressure or more, and the uniform dope is extruded through a pressure let-down zone having a pressure of a two-liquid-phase boundary pressure or less, into an environment of an atmospheric pressure to thereby obtain a fiber. In these processes, the type of solvent, concentration of the isotactic polypropylene, MFR of the isotactic polypropylene, a temperature and a pressure of a solution prepared from the solvent and the isotactic polypropylene, a relationship between MFR, a concentration of the polypropylene and a temperature of the solution during an extruding operation, or the like have been suitably selected. In Japanese Unexamined Patent Publication (Kokai) No. 62-33816, the diameter of a nozzle is specified.

In a method of manufacturing a polypropylene three-dimensional plexifilamentary fiber disclosed in Japanese Unexamined Patent Publications (Kokai) No. 1-104814 and No. 1-132819, and the corresponding PCT application of PCT/JP87-00808, filed by the same inventors as those in the present application, a specific temperature and pressure of the solution were selected and a dope having a high viscosity was used. In particular, when manufacturing a highly spread plexifilamentary fiber, a spreading agent was added to the dope, the dope with the spreading agent was spun and then subjected to a spreading operation.

Several problems arising in the conventional polypropylene three-dimensional plexifilamentary fiber will be described hereafter.

A serious problem arising with the conventional known polypropylene three-dimensional plexifilamentary fiber is that the fiber spreadability is poor, and accordingly, it is impossible to make a nonwoven fabric having superior characteristics from the known polypropylene three-dimensional plexifilamentary fiber. With regard to the above, the polypropylene is inferior to a high-density polyethylene known to date.

The term "fiber spreadability" in the present specification means that a fiber extruded from a spinneret having a hole is separated into finer units e.g., each fibril constituting a plexifilamentary fiber.

A fiber spreading degree expressing a quality of the fiber spreadability can be evaluated by a number of free-fibrils and a fiber width thereof. The number of free-fibrils is a measure expressing a degree by which the fiber is spread to the finer unit and is shown as a number of separated fibrils per unit weight of the fiber. A larger value of the number of free-fibrils shows that the fiber is more finely separated.

The fiber width is a extent in a direction perpendicular to an axis of the fiber observed when a fiber extruded from the single hole of the spinneret is widen in a two-dimensional state in both an axial direction of the fiber and a direction perpendicular to the axial direction of the fiber. Since the fiber width depends on a quantity of the fiber used for measuring the fiber width, the fiber width is expressed as a value per unit quantity of the fiber, e.g., 10 mm/100 d. When the fiber is uniformly spread in a widthwise direction of the fiber, it is possible to approximately evaluate the fiber spreading degree only from the fiber width.

It is usually necessary for the fiber width to be 20 mm/100 d or more, to obtain a nonwoven fabric having a light weight per unit area and a high uniformity by piling a plurality of spread fibers, preferably 30 mm/100 d or more.

Nevertheless, even if the conventional known conventional polypropylene plexifilamentary fibers are spread by using an impingement plate, the obtained fiber width of the fiber is 10 mm/100 d at most.

Another problem of the known conventional polypropylene plexifilamentary fiber is that a strength of the fiber is lower. For example, Japanese Examined Patent Publication (Kokoku) No. 42-19520 disclosed a method of spreading a fiber stream extruded from a spinneret, by arranging an impingement plate in such a manner that the fiber stream is impinged on the impingement plate. A tensile strength of the fiber shown in an Example 9 in this publication is only 0.53 g/d, which is too low as a value of the fibers used in the nonwoven fabric.

As described herebefore, it has been difficult to obtain a plexifilamentary fiber having a high tensile strength and a large fiber width by using a polypropylene polymer, and although an improvement in which a nozzle of the spinneret is provided with a rectangular groove has been proposed, to solve the above problems, as disclosed in U.S. Pat. No. 3,467,744, U.S. Pat. No. 3,564,088 and Japanese Unexamined Patent Publication (Kokai) No. 49-42917, and a plexifilamentary fiber having a large fiber width can be obtained by this improvement, a tensile strength of the obtained fiber is still too low. Further, it is difficult to apply a dispersing and piling operation required when manufacturing a nonwoven fabric, which is a main application of a flash spun fiber.

Another problem of the conventional known polypropylene three-dimensional plexifilamentary fiber is that a thermal stability thereof is poor, that is, a dimensional stability under a heated atmosphere is poor, resulting in a large elongation and an easy deformation in a heated atmosphere.

As described herebefore, the same inventors as those of the present invention proposed the polypropylene three-dimensional plexifilamentary fiber having an improved tensile strength and thermal stability, and a superior fiber spreadability, and manufactured by adding a spreading agent, in Japanese Unexamined Patent Publications (Kokai) No. 1-104814 and No. 1-132819, and the corresponding PCT application No. PCT/JP87-00808. Nevertheless, the inventors found that a problem arose due to the use of the spreading agent, after filing the applications relating to the above fiber and a method of manufacturing the fiber. Namely, a clogging in a filter of a spinning apparatus is generated by the spreading agent which is little solved in a solvent under a high temperature and a high pressure, such as a benzoate, an inorganic powder, a polyamide resin or the like, and further, the nozzles of the spinneret are clogged, resulting in an obstruction of a staple spinning of the fiber.

Recently, problems regarding a solvent used for spinning a polypropylene three-dimensional plexifilamentary fiber has arisen. Namely, restriction of a production and consumption of a specified chlorinated hydrocarbon or a specified brominated hydrocarbon in which all of the hydrogen is substituted by a halogen, was started.

As the solvent used for manufacturing a polypropylene three-dimensional plexifilamentary fiber, U.S. Pat. No. 3,467,744 and U.S. Pat. No. 3,568,088 disclosed a 1,1,2-trichloro-1,2,2-trifluoroethane, and U.S. Pat. No. 3,568,088, U.S. Pat. No. 3,756,441, Japanese Unexamined Patent Publications (Kokai) No. 1-104814 and No. 1-111009 disclosed a trichlorofluoromethane.

When a nonwoven fabric, which is a main application of a flush spun fiber, is manufactured from the polypropylene three-dimensional plexifilamentary fiber by accumulating spread fibers to make a web, the spread fibers are usually electrostatically charged by a corona discharge, as disclosed in U.S. Pat. No. 3,456,156. In this case, when a combustible solvent is used, there is a risk of an ignition or an explosion of the solvent. Accordingly, a nonflammable solvent must be used for this purpose. The nonflammable solvent is generally selected from a chlorinated hydrocarbon, a fluorinated hydrocarbon, a chlorinated and fluorinated hydrocarbon. In practice, a trichlorofluoromethane, 1,1,2-trichloro-1,2,2-trifluoroethane, a dichloromethane, and a mixture of the above solvents or the like, are preferably used.

Further, to protect the ozone layer, the Vienna Treaty was adopted on 1985, followed by the Montreal Protocol in which the content of Vienna Treaty is concretely determined. Accordingly, a law stemming from the Vienna Treaty and Montreal Protocol was established in Japan, and a control based on the above law started from July, 1989. Namely, a production and a consumption of a specified material, having an especially large influence on the depletion of the ozone layer in various specified chlorinated or brominated hydrocarbons in which all of the hydrogen is substituted by the halogen and having a superior stability in the atmosphere and a large ozone layer depletion potential have been controlled.

The above-described trichlorofluoroethane and 1,1,2-trichloro-1,2,2-trifluoroethane were fall under this control, and the production and consumption of the specified chlorinated or brominated hydrocarbons in which all of the hydrogen is substituted by the halogen may be completely stopped by the year 2000.

From the above-described situation, the use of a chlorinated and fluorinated hydrocarbon in which all the hydrogen is substituted by a chlorine and a fluorine, having a superior stability in the atmosphere and broadly used as a preferable solvent for manufacturing the polypropylene three-dimensional plexifilamentary fiber, becomes difficult. Accordingly, a solvent having suitable characteristics for manufacturing the polypropylene three-dimensional plexifilamentary fiber and having a lower ozone layer depletion potential is now required.

SUMMARY OF THE INVENTION

The present invention aims to provide a novel polypropylene three-dimensional plexifilamentary fiber free of a spreading agent and having a high fiber spreadability, a high thermal dimensional stability, and a superior processability.

A second object of the present invention is to provide a novel dope capable of stably manufacturing the polypropylene three-dimensional plexifilamentary fiber free of a spreading agent and having a high fiber spreadability, a high thermal dimensional stability and a superior processability, and preferably in which a substance having a lower ozone layer depletion potential is used as a solvent in the dope.

A third object of the present invention is to provide a novel method of manufacturing the polypropylene three-dimensional plexifilamentary fiber in accordance with the present invention.

The primary object of the present invention is attained by a polypropylene fibrillated three-dimensional plexifilamentary fiber characterized in that the fiber has a microwave birefringence of 0.07 or more and $\overline{M}w/\overline{M}n$ of 4.3 or less, wherein $\overline{M}w$ stands for a weight-average molecular weight and $\overline{M}n$ stands for a number-average molecular weight.

The second object of the present invention is attained by a dope from which a fibrillated three-dimensional plexifilamentary fiber of an isotactic polypropylene is spun, characterized in that the dope is composed of an isotactic polypropylene having $\overline{M}w/\overline{M}n$ of 4.3 or less and MFR of 20 or less, and a halogenated hydrocarbon used as a solvent of the isotactic polypropylene. To prevent the depletion of the ozone layer, it is preferable to use a 2,2-dichloro-1,1,1-trifluoroethane or a 1,2-dichloro-trifluoroethane as the halogenated hydrocarbon.

The third object of the present invention is attained by a method of manufacturing a fibrillated isotactic polypropylene obtained by passing a dope composed of an isotactic polypropylene and a halogenated hydrocarbon through a pressure let-down chamber and a spinneret, and extruding the dope into a lower temperature and lower pressure zone, characterized in that a dope composed of an isotactic polypropylene having $\overline{M}w/\overline{M}n$ of 4.3 or less and MFR of 20 or less and a halogenated hydrocarbon used as a solvent of the isotactic polypropylene is used.

DESCRIPTION OF THE PREFERRED EMBODIMENTS

Figure 1:
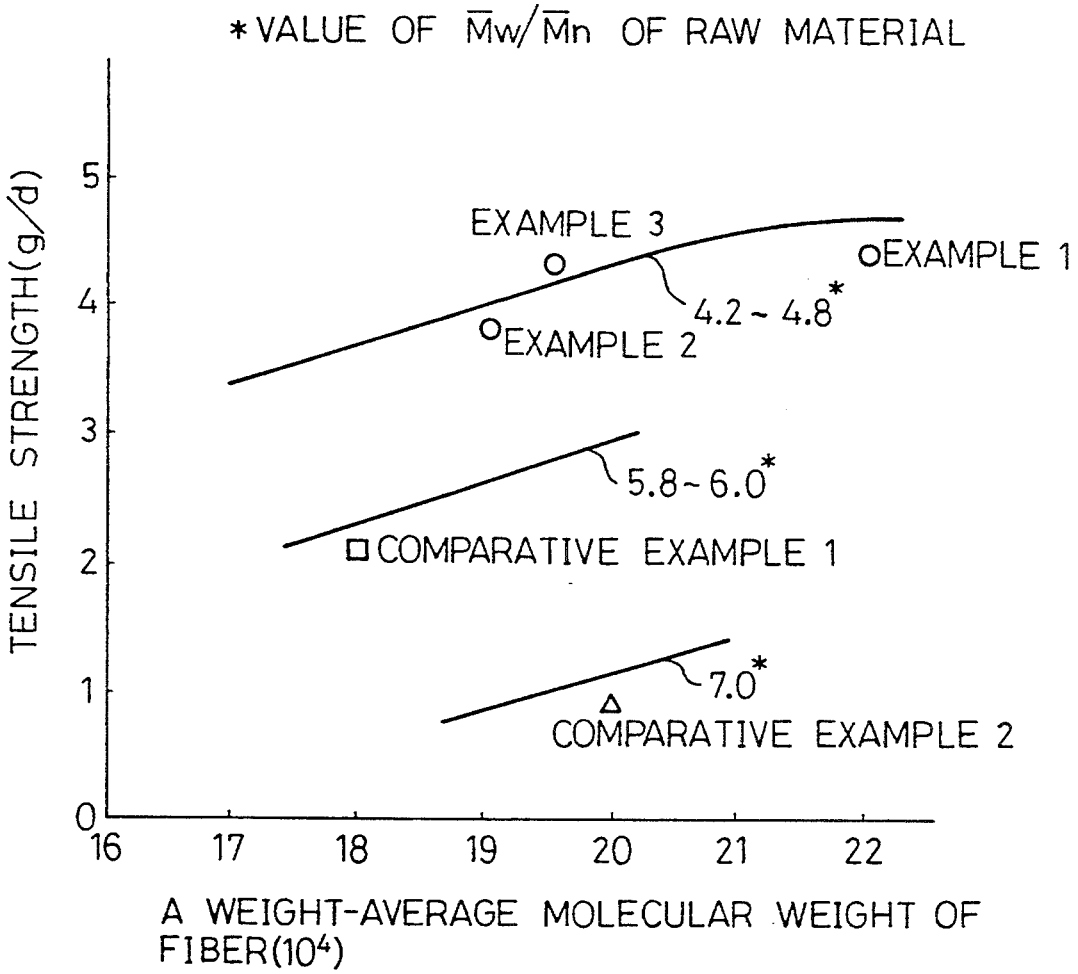
FIG. 1 is a graph explaining a relationship between a weight-average molecular weight $\overline{M}w$ and a tensile strength in various fibers manufactured by using isotactic polypropylene raw materials having different values of a weight-average molecular weight per a number-average molecular weight.

The present invention will be described in detail hereinafter with reference to the accompanying drawings, which are used for explaining a polypropylene three-dimensional plexifilamentary fiber, and a dope used for manufacturing the fiber in accordance with the present invention.

First, a polypropylene fibrillated three-dimensional plexifilamentary fiber in accordance with the present invention will be described.

The feature of the fiber in accordance with the present invention is that the fiber has a microwave birefringence of 0.07 or more and $\overline{M}w/\overline{M}n$ of 4.3 or less, and this fiber is free of a spreading agent.

When the microwave birefringence of the obtained fiber is 0.07 or more and the $\overline{M}w/\overline{M}n$ of the obtained fiber is 4.3 or less, a fiber having the same fiber spreadability or more compared with a polypropylene three-dimensional plexifilamentary fiber including a spreading agent can be obtained. Accordingly, it becomes unnecessary to add the spreading agent to the fiber and a dope used for manufacturing the fiber by the present invention.

There is a tendency for a lower value of $\overline{M}w/\overline{M}n$ of the fiber to be used, and a higher fiber spreadability is obtained. Accordingly it is preferable to adopt an $\overline{M}w/\overline{M}n$ of 3.8 or less.

Further, preferably a melt flow rate (hereafter, referred to as MFR) of a polymer constituting the fiber is between 2 and 20. When the polymer having an MFR of 20 or more is used, it is difficult to obtain a fiber having a high tensile strength, and when the polymer having a lower MFR value is used, the tensile strength becomes higher. When the polymer having an MFR of 2 or less is used, a fibrillation of the fiber is not sufficient, resulting in a lower tensile strength. More preferably, the MFR is between 3.5 and 10.

The value of the MFR of the polymer corresponds generally to a weight average molecular weight of the polymer. Accordingly, a preferable range of the polymer. Accordingly, a preferable range of the weight-average molecular weight of the polypropylene three-dimensional plexifilamentary fiber is approximately between $15\times10^4$ and $28\times10^4$, more preferably approximately between $18\times10^4$ and $25\times10^4$.

In the polypropylene three-dimensional plexifilamentary fiber satisfying the microwave birefringence of 0.07 or more, $\overline{M}w/\overline{M}n$ of 4.3 or less and MFR of between 2 and 20, a tensile strength of the fiber is approximately 2 g/d, and an elongation under heat is about 8% or less at 100° C. and about 12% or less at 130° C. When the fiber has a microwave birefringence of 0.10 or more, a tensile strength of the fiber is about 3.5 g/d or more, and an elongation under heat is about 4% or less at 100° C. and about 6% or less at 130° C. Further, if the value of the $\overline{M}w/\overline{M}n$ of the fiber becomes to a small, the tensile strength of the fiber becomes to a high.

In the fiber in accordance with the present invention, the microwave birefringence effects mainly an improvement of a thermal dimensional stability and the $\overline{M}w/\overline{M}n$ effects mainly an improvement of a fiber spreadability and a tensile strength of the fiber. However, each factor effects the improvements of each characteristic with a mutually affected relationships, and the polypropylene three-dimensional plexifilamentary fiber having superior characteristics in accordance with the present invention can be obtained by simultaneously only by satisfying the desirable values of the microwave birefringence and $\overline{M}w/\overline{M}n$.

The polypropylene three-dimensional plexifilamentary fiber in accordance with the present invention has essentially a superior fiber spreadability as described above, and accordingly, when the obtained fiber is subjected to a spreading operation well known in this technical field, a spread fiber having a number of free fibrils of 100/50 d or more and a fiber width of 20 mm/100 d or more can be obtained, and a nonwoven fabric having a high utility can be obtained by piling the obtained spread fibers to make a web, and heat-bonding the web.

A definition and a method of measuring technical terms expressing the characteristics of the fiber in accordance with the present invention will be described hereafter.

A microwave birefringence ($\Delta n$) is meant the difference ($\Delta n = n_{MD} - n_{TD}$) between the refractive index ($n_{MD}$) in the direction of the fiber axis and the refractive index ($n_{TD}$) in the direction perpendicular to the fiber axis, determined by electromagnetic waves of the microwave region (the frequency range of from 0.3 GHz to 30 GHz). The orientation of the molecule, that is the orientation of the crystalline region and the amorphous region can be evaluated based on the microwave birefringence as well as the birefringence determined by the so-called optical measurement method using visible waves. For the fiber of the present invention having a non-circular cross-section, the measurement is difficult by the customary measurement method using a polarization microscope because the fibril thickness greatly differs and the method using microwaves is effective.

The microwave birefringence is measured at a frequency of 4.0 GHz by a microwave molecule orientation meter (Model MOA-2001A supplied by Kanzaki Seishi K.K.). Specimens used for the measurement are prepared by arranging the fiber in the parallel state in holders such that a width of the fiber is 10 mm, a necessary length is 75 mm and a substantial thickness is about 100 $\mu$m. The substantial thickness, which is necessary for calculating the microwave birefringence, is calculated from a number of fibers, a fineness and density of the fibers.

In $\overline{M}w/\overline{M}n$, $\overline{M}w$ stands for a weight-average molecular weight and $\overline{M}n$ stands for a number-average molecular weight, as described before. The weight-average molecular weight and the number-average molecular weight are measured at the temperature of 135° C. by gas chromatography (Model 150-CGPC supplied by Waters Co., Ltd.). In this measurement, trichlorobenzene is used as a solvent. Since a monodispersed standard specimen of a polypropylene is difficult to obtain, a conversion value used for a polyethylene is used. Namely, a molecular weight conversion factor obtained from a relationship between a standard specimen of a polystyrene and a standard specimen of a polyethylene is used.

The thermal dimensional stability can be evaluated by an elongation under heating of the fiber, the elongation under heating is measured at the heat-up rate of 5° C./min and at the temperature between 30° C. and 170° C., by a thermal mechanical analysis apparatus (Model TMA-40 supplied by Shimazu Seisakusho K.K.). In the measurement, a fineness of a sample is measured, a load of 0.1 g/d, i.e., a load of about 810 gf/mm$^2$, is applied to an end of the sample, and the sample is held between two chucks separated by about 2 mm to 4 mm. When a spread fiber is measured, the sample is measured after a twist of 8 turns per cm is applied.

The tensile strength and elongation of the fiber are measured at a pulling speed of 200 mm/min, by an Instron tensile tester, with respect to a sample twisted at 8 turns per cm.

The measurement of the fineness and the twist operation of the fiber are performed on a sample applied with an initial load of 0.6 g/d, except where a breakage occurs or a drawing of the fiber is generated, because there is no probability that the drawing of the fiber will be generated under the load of 0.6 g/d. In particular, it is necessary to use the initial load of 0.6 g/d when a spread fiber of an isotactic polypropylene is measured, because this spread fiber has a high elasticity. Accordingly, if a smaller initial load than 0.6 g/d is used, the measurement of fineness and the twist operation are performed for the spread fiber holding flexed fibrils applied by spreading operation, and thus an erroneous measurement is obtained. When the breakage of the fiber is generated under the initial load of 0.6 g/d, the initial load is lowered to a value at which the fiber will not break.

The number of free fibrils is measured by counting the number of separated fibrils, by using a microscope with an object lens of 1.6 magnifications and an eyepiece of 10 magnifications, and moving a visual field in the transverse direction of the fiber.

The fiber width is obtained by peeling a spread fiber from a slightly pressed web formed by piling the spread fibers and measuring a fiber width perpendicular to an axis of the spread fiber. When the web is not formed, the fiber width is measured by receiving the fiber in the spread state after the spreading operation on a net of a coarse mesh size (about 10 mesh).

A dope from which a polypropylene fibrillated three-dimensional plexifilamentary fiber of an isotactic polypropylene is spun will be described hereafter.

It is necessary to improve characteristic of the dope from which the polypropylene fibrillated three-dimensional plexifilamentary fiber is spun, to manufacture the fiber in accordance with the first invention in this application free from a spreading agent.

Namely, the second object of the present invention is attained by a dope composed of an isotactic polypropylene having an $\overline{M}w/\overline{M}n$ of 4.3 or less and an MFR of 20 or less, and a halogenated hydrocarbon used as a solvent of the isotactic polypropylene.

The $\overline{M}w/\overline{M}n$ and MFR of the isotactic polypropylene in the dope cannot be measured. Accordingly, it is assumed that the values of the $\overline{M}w/\overline{M}n$ and MFR of the isotactic polypropylene in the dope are substantially identical to those of the fiber extruded from a spinneret, and the $\overline{M}w/\overline{M}n$ and MFR of the fiber are measured and used as $\overline{M}w/\overline{M}n$ and MFR of the isotactic polypropylene in the dope.

When the isotactic polypropylene in the dope having an $\overline{M}w/\overline{M}n$ of 4.3 or less and an MFR of 20 or less is used, a polypropylene three-dimensional flexifilamentary fiber having a high fiber spreadability in accordance with the present invention can be stably manufactured. It is preferable to use the isotactic polypropylene in the dope having an MFR of 2 or more and a smaller $\overline{M}w/\overline{M}n$. When the isotactic polypropylene in the dope has an $\overline{M}w/\overline{M}n$ of 4.3 or more, the fiber spreading degree of the obtained fiber becomes lower and a pressure in a pressure let-down chamber of a spinning apparatus fluctuates. Accordingly, it is impossible to obtain a stable spinning operation. More preferably, the $\overline{M}w/\overline{M}n$ is 3.8 or less and the MFR is 10 or less.

To obtain the second object of the present invention, preferably the dope is prepared by using an isotactic polypropylene having an $\overline{M}w/\overline{M}n$ of 4.8 or less and an MFR of 7 or less, as a polymer of a raw material. This condition must be applied for a process in which a melting operation of the isotactic polypropylene and an preparation of a solution composed of the isotactic polypropylene and a solvent, using an apparatus in which a retention time of the isotactic polypropylene and the solution in a spinning apparatus is short e.g., an extruder. When the isotactic polypropylene used as the polymer of the raw material has an $\overline{M}w/\overline{M}n$ of 4.8 or less and an MFR of 7 or less, even if the retention time of the isotactic polypropylene is short, such as within 2 minutes, a fiber having a high fiber spreadability can be stably manufactured.

When the dope is prepared by using an apparatus in which the retention time of the isotactic polypropylene and the solution in the spinning apparatus is relatively long, e.g., an autoclave, the above condition is not always necessary. But the conditions required for the characteristics of the dope must be also satisfied in this latter case, to manufacture a fiber having good characteristics, in a stable spinning operation.

It is important to use a halogenated hydrocarbon group as a solvent. These solvents have high solving power and are mostly nonflammable. Accordingly, it is possible to solve the isotactic polypropylene at a high temperature, e.g., 215° C., and high pressure, e.g., 200 $kg/cm^2G$, to prepare the dope by using the halogenated hydrocarbon.

FIG. 1 shows a relationship between a weight average molecular weight $\overline{M}w$ and a tensile strength in various fibers manufactured by using isotactic polypropylene raw materials having different $\overline{M}w/\overline{M}n$ values. In FIG. 1, the effects of examples 1 to 3 and comparative examples 1 and 2, as described in detail hereinafter, are plotted. As shown in FIG. 1, the tensile strength of the fiber depends on the weight-average molecular weight $\overline{M}w$ of the fiber, i.e., the higher the $\overline{M}w$ of the fiber, is the higher the tensile strength of the fiber. Nevertheless, the tensile strength of the fiber depends more strongly on the $\overline{M}w/\overline{M}n$ of the isotactic polypropylene used as the raw material. Namely, when the fiber is spun from a dope prepared by using an isotactic polypropylene having an $\overline{M}w/\overline{M}n$ of 4.8 or less and an MFR of 7 or less, the tensile strength of the fiber becomes higher.

It is essential in the present invention that the MFR of the isotactic polypropylene be 7 or less. When the isotactic polypropylene used as the raw material has an $\overline{M}w/\overline{M}n$ of 4.8 or more and an MFR of 7 or less, the microwave birefringence of the fiber satisfies the condition of 0.07 or more, and a polypropylene three-dimensional flexifilamentary fiber having a high tensile strength and a high thermal dimensional stability can be obtained. When the MFR is larger than 7, the thermal dimensional stability of the fiber is often lowered and the tensile strength thereof becomes poor.

The MFR is measured at a temperature of 230° C. under a load of 2.16 kg, by using a melt indexer supplied by Toyo Seiki Seisakusho according to JIS K-7210.

It is difficult to commercially obtain an isotactic polypropylene having an $\overline{M}w/\overline{M}n$ of 4.8 or less but a molecular weight of a relatively large value, and having an MFR of 7 or less, and accordingly, it is important to adjust a market grade polypropylene polymer to form a polypropylene polymer satisfying the above-described conditions. Namely, a polypropylene polymer to be used for a dope and having an MFR of 7 or less, preferably 3.5 or less and an $\overline{M}w/\overline{M}n$ of 4.8 or less, preferably 4.5 or less is made by degradating a raw material of the polypropylene having a relatively large molecular weight, e.g., an MFR of 1.5 or less and an $\overline{M}w/\overline{M}n$ of 4.8 or more.

It is possible to use the following two methods to degradate the polypropylene. The first method is a degradating method using heat, and the second method is a degradating method using a decomposer such as an organic peroxide or the like.

The first method is carried out by processing a polymer through an extruder in which the polymer is melted, and the second method is carried out by mixing a decomposer such as organic peroxide with a polymer chip and processing the polymer with the decomposer in the extruder.

The MFR of the raw material degradated by heat lies within a relatively broad range and has a larger variance. Further, although a relatively lower degradation of the polymer can be only attained by heating, in the degradation using the decomposer, a degree of degradating of the polymer is directly determined by a quantity of the decomposer used. Accordingly it is possible to control the MFR of the degradated polymer on the basis of the quantity of the decomposer used. Further, a range of the MFR of the degradated polymer is narrow and a variance of the MFR is a small. Even if the decomposer remains in the polymer, the remaining decomposer will not have an undesirable effect on the subsequent process. Therefore, the degradating by the decomposer is preferable to the degradating by heat.

It is preferable to use a 1,3-bis(t-butylperoxiisopropyl)benzene, a 2,5-dimethyl 2,5-di-(t-butylperoxi)-hexane or dialkylperoxide such as 2,5-dimethyl-2,5-di(t-butylperoxi)hexyne-3 or the like as the decomposer. When the MFR of the raw material is degradated from 0.5 to a value of between 2.0 and 3.0, by using the 1,3-bis(t-butylperoxiisopropyl)benzene as the decomposer, between 100 ppm and 160 ppm of the decomposer may be added to the raw material.

A single screw extruder may be used to uniformly degradate the polymer. Further preferably a mixing portion such as a dulmage type mixing portion is provided on the extruder.

Usually, a raw material degradated as described before may be stocked and supplied to a flash spinning process, but the polymer can be degradated just before the polymer solution is prepared from the polymer and the solvent. Namely, in the flash spinning process in which the polymer of a raw material is melted by an extruder and is supplied to a solution preparing portion, the degradating process may be performed before the molten polymer is mixed with a solvent.

When the dope in accordance with the present invention is prepared, it is possible to prevent a depletion of the ozone layer by using a 2,2-dichloro-1,1,1-trifluoroethane or a 1,2-dichloro-trifluoroethane as a halogenated hydrocarbon.

Figure 2:
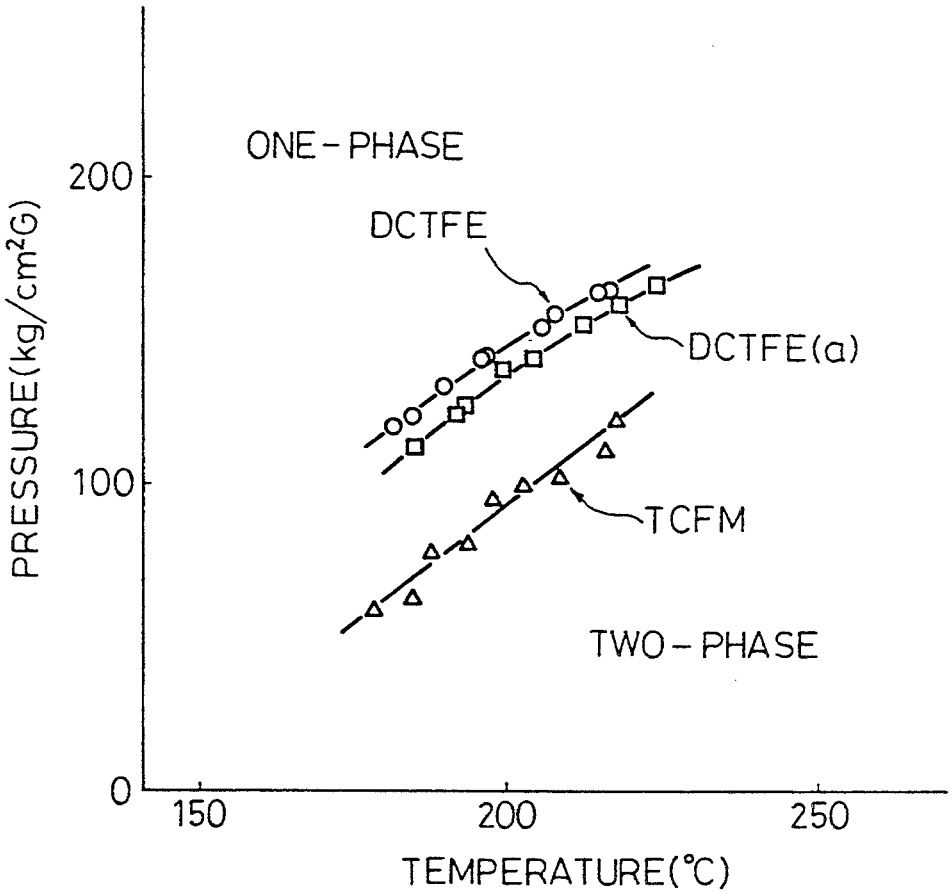
FIG. 2 is a graph illustrating cloud point curves of dopes in accordance with the present invention and composed of a polypropylene and various halogenated hydrocarbons.

FIG. 2 shows examples of phase charts of dopes composed of an isotactic polypropylene and a 2,2-dichloro-1,1,1-trifluoroethane or a 1,2-dichloro-trifluoroethane. In FIG. 2, cloud points show the generation of a phase separation. An observation of the cloud point is performed by an autoclave with two viewing windows through which light can pass. An extinction initiation point and an extinction termination point can be observed for the dope including the polypropylene. In FIG. 2, the cloud points are expressed by the extinction termination points. As can be seen from FIG. 2, the cloud points of the two above halogenated hydrocarbons are biased toward a lower temperature and a higher pressure than those using a conventional solvent for the polypropylene, i.e., a trichlorofluoromethane.

The most important feature when using either of the two above halogenated hydrocarbons is that a volume of the solution extruded from a spinneret is larger. For example, the volume of the solution in this case is about two times that in which a trichlorofluoromethane is used as a solvent. Even if a spinneret having a hole of the same diameter is used, the productivity of a fiber when using either one of the above two halogenated hydrocarbons is about two times greater than that of the latter case. It appears that the increase of the productivity obtained by using either one of the above two halogenated hydrocarbons is because a suitable pressure in a pressure let-down chamber is a higher pressure and critical pressure is lower pressure.

With regard to protection of the ozone layer, an ozone depletion potential is calculated at 0.02 for the 2,2-dichloro-1,1,1-trifluoroethane and it appears that the ozone depletion potential of the 1,2-dichloro-trifluoroethane has the same level as that of 2,2-dichloro-1,1,1-trifluoroethane, but the ozone depletion potential of a trichlorofluoromethane is calculated as 1.00. Accordingly, the above two halogenated hydrocarbons are suitable for preventing the depletion of the ozone layer.

Figure 3:
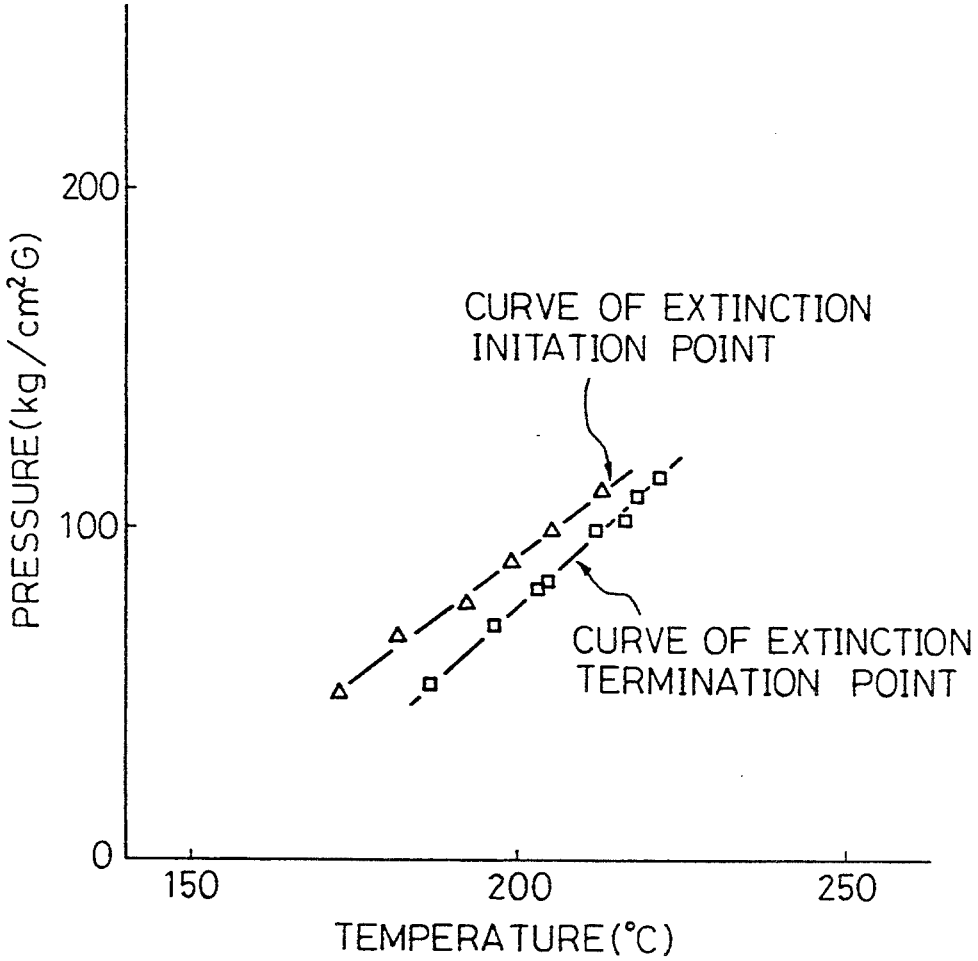
FIG. 3 is a graph illustrating a cloud point curves of dopes in accordance with the present invention and composed of a polypropylene and a blended halogenated hydrocarbon.

When the 2,2-dichloro-1,1,1-trifluoroethane or the 1,2-dichloro-trifluoroethane is used as the halogenated hydrocarbon, a dichloromethane is preferably added to either one of the above two halogenated hydrocarbon, by 80 wt % of the total weight of the solvent. The blended solvent has the same solubility as that of a solvent constituted with the same component. FIG. 3 shows a curve of an extinction termination point when a solvent blended with a dichloromethane of 50 wt % and 2,2-dichloro-1,1,1-trifluoromethane of 50 wt % is used, and cloud points are clearly observed.

As can be seen when comparing FIG. 3 with FIG. 2, each cloud point moves toward a higher temperature side and a lower pressure side. Further, a range of moving of the cloud point depends on a weight of the dichloromethane added to the solvent. Accordingly, it is possible to spin the fiber under the same temperature and pressure as when a conventional trichlorofluoromethane is used, by changing a blending weight of the dichloromethane. For example, when preparing a dope including 10 wt % of the isotactic polypropylene having an $\overline{M}w/\overline{M}n$ of 4.0 and an MFR of 6 by using a solvent blended with the 2,2-dichloro-1,1,1-trifluoroethane of 20 wt % and the dichloromethane of 80 wt %, the isotactic polypropylene can be dissolved at the temperature of 215° C. and a pressure of between 70 $kg/cm^2G$ and 165 $kg/cm^2G$. When the dichloromethane is over 80 wt % in the solvent, the spreadability of the obtained fiber becomes lower, it is necessary to make a suitable spinning temperature higher to have the spread ability, and this causes a retrogradation of the polypropylene. Then, the strength of the obtained fiber becomes weak.

Since the ozone layer depletion potential of the dichloromethane is extremely weak, the above blended solvent is useful for the prevention of the depletion of the ozone layer.

A method of manufacturing the polypropylene three-dimensional plexifilamentary fiber in accordance with the present invention will be described hereafter.

As described herebefore, in a method of manufacturing a fibrillated three-dimensional plexifilamentary fiber of an isotactic polypropylene obtained by passing a dope composed of an isotactic polypropylene and a halogenated hydrocarbon through a pressure let-down chamber and a spinneret, and extruding the dope into a lower temperature and lower pressure zone, the third object of the present invention can be attained by a method characterized in that a dope composed of an isotactic polypropylene having an $\overline{M}w/\overline{M}n$ of 4.3 or less and an MFR of 20 or less, and a halogenated hydrocarbon used as a solvent of the isotactic polypropylene, is used.

In the above manufacturing method, preferably a dope prepared by using an isotactic polypropylene having $\overline{M}w/\overline{M}n$ of 4.8 or less and MFR of 7 or less as a polymer of a raw material is used, and it is preferable to use 2,2-dichloro-1,1,1-trifluoroethane or 1,2-dichloro-trifluoroethane as the halogenated hydrocarbon. Further, it is preferable to use a solvent including a dichloromethane having a content of 80 wt % or less in the solvent and another halogenated hydrocarbon.

A concentration of the isotactic polypropylene in the solution may be between 5 wt % and 20 wt %. When the concentration of the isotactic polypropylene in the solution is below 5 wt %, it is difficult to obtain a fiber having a suitable microwave birefringence value and a tensile strength of the obtained fiber becomes poor. The higher the concentration of the isotactic polypropylene, the higher the tensile strength of the fiber. Therefore, the preferable value of the concentration is 8 wt % or more. Nevertheless when a solution in which the concentration of the isotactic polypropylene is over 20 wt % is used, the flowability of the solution drops, and a flashing power thereof is weakened, which results in an inferior fiber spreadability of the obtained fiber. Further it is impossible to obtain a highly spread fiber constituted with a plurality of fine fibrils.

A conventional known method can be used as a flash spinning technique. Namely, the flash spinning of the fiber in accordance with the present invention can be attained by keeping a solution in which the isotactic polypropylene is dissolved with the halogenated hydrocarbon such as the 2,2-dichloro-1,1,1-trifluoroethane or the like under a high temperature and a high pressure, reducing a pressure of the solution in a pressure let-down chamber to lower the pressure thereof to a pressure below a phase separating point, and extruding the solution through a spinneret into a zone having a low temperature and a low pressure. It is preferable to use a method in which a solution flow extruded from the spinneret is impinged onto an impingement plate as a fiber spreading operation.

Suitable conditions for the flash spinning method will be described hereafter.

A desirable flash spinning may be performed by a flash spinning apparatus in which a screw type extruder, a solvent introducing zone, a mixing zone, a pressure let-down chamber, and a spinneret are consecutively arranged. First, the isotactic polypropylene having the specific characteristics described herebefore as the raw material is supplied into and melted in the screw type extruder, and the molten isotactic polypropylene is blended with the halogenated hydrocarbon supplied from the solvent introducing zone in the mixing zone to make a homogeneous solution. It is important to keep the pressure of the solution in the position upstream of the pressure let-down chamber at a pressure higher than the pressure in the corresponding extinction initiation point of the solution used, to stably spin the fiber, but it is possible to use a condition exceeding the pressure and the temperature in the corresponding extinction termination point of the solution used, at a position just upstream of the pressure let-down chamber. Namely, in this position, if the temperature used is the same as that in the extinction termination point, the pressure shifted from the pressure of the extinction termination point toward a higher pressure may be adopted, and if the pressure used is the same as that in the extinction termination point, the temperature shifted from the temperature of the extinction termination point toward a lower temperature may be adopted.

An orifice may be provided between the mixing zone under the high pressure and the pressure let-down chamber, and a temperature in the pressure let-down chamber is preferably between 198° C. and 220° C. When the temperature is under 198° C., it is impossible to increase a flow volume of the solution, which results in a lower flowability and a weaker flashing power. Therefore, the obtained fiber extruded from the spinneret has a lower orientation and it is difficult to spin a fiber having a high microwave birefringence. When the temperature is over 220° C., an adhering between fibrils and retrogradation of the polypropylene is likely to be generated.

It is preferable to use a pressure below the pressure in the corresponding extinction termination point of the solution used as in the pressure of the pressure let-down chamber. If a pressure higher than the pressure in the corresponding extinction termination point is used in the pressure let-down chamber, the obtained fiber has a fiber configuration in which particle-like materials appear because the fiber is not fibrillated, which results in a fiber having a high elongation and a low tensile strength, and an elongation under heating of the fiber becomes higher. If a pressure below a vapor pressure of the halogenated hydrocarbon is used in the pressure let-down chamber, breakage of the fibrils is generated, which results in a lower microwave birefringence and a higher elongation under heating.

In the present invention, the isotactic polypropylene used comprises about 85 wt % or more of the isotactic polypropylene, and another polymer component such as ethylene, n-butylene, isobutylene, vinyl acetate or methyl methacrylate can be used in an amount of up to about 15 wt %. Moreover, additives such as an antioxidant, an ultraviolet absorber, a lubricant, a filler, a nucleating agent, an antistatic agent and a colorant can be added in amounts that will not degrade the characteristics of the isotactic polypropylene.

When a dope satisfying claims 3 to 8 is used, the dissolution of the isotactic polypropylene and the extrusion of the dope can be accomplished not only by the continuous method using a screw extruder as described herebefore but also by a batchwise method using an autoclave or the like.

As described herebefore, the fiber in accordance with the present invention has specific microwave birefringence value and $\overline{M}w/\overline{M}n$, and further, has the following features. Namely the orientation angle of the fiber measured by X-ray diffractometry is about 36° or less, preferably 30° or less. The long period of the fiber is preferably between 75 Å and 140 Å. The apparent density of the fiber is 0.895 g/cm$^3$ or more, preferably 0.90 g/cm$^3$ or more, and the specific surface area of the fiber is preferably between 2 m$^2$/g and 30 m$^2$/g.

As described herebefore, the same inventors as those of the present invention proposed a prototype of the polypropylene three-dimensional plexifilamentary fiber, in PCT application of No. PCT/JP87/00808. To clarify the differences between the present invention and the invention claimed in the PCT application No. PCT/JP87/00808, the differences in the main characteristics of both inventions is shown in Table 1.

TABLE 1

| Polymer used | Present Invention Isotactic Polypropylene | Invention of PCT/JP87/008 Isotactic Polypropylene |
|---|---|---|
| Polymer used as Raw Material | | |
| $\overline{M}w/\overline{M}n$ | 4.8 or less | Not Defined |
| MFR | 7 or less | Not Defined |
| Polymer in Dope | | |
| $\overline{M}w/\overline{M}n$ | 4.3 or less | Not Defined |
| MFR | 20 or less | Not Defined |
| Fiber | | |
| Microwave Birefringence | 0.07 or more | 0.07 or more |
| Mw/Mn | 4.3 or less | Not Defined |
| Spreading Agent | Not used | Used |
| Solvent | | |
| preferable solvent | 2,2-dichloro-1,1,1-trifluoroethane 1,2-dichlorotrifluoroethane Blended solvent including dichloromethane of 80 wt % or less and either one of the above two solvents | Trichlorofluoromethane |

The features of the polypropylene three-dimensional plexifilamentary fiber, the dope used for manufacturing the fiber, and the method of manufacturing the fiber will be described hereafter.

The polypropylene three-dimensional plexifilamentary fiber in accordance with the present invention has a superior fiber spreadability, and accordingly, it is possible to manufacture a nonwoven fabric having a high uniformity in the thickness and appearance thereof. Further, the fiber having an MFR value satisfying a factor defined in the claim has a superior thermal dimensional stability and a high tensile strength, and thus it is possible to manufacture a nonwoven fabric having a superior dimensional stability and high tensile strength in a heated atmosphere.

The polypropylene three-dimensional plexifilamentary fiber in accordance with the present invention can be stably manufactured by using the novel dope in accordance with the present invention. Since it is unnecessary to include a spreading agent in the dope, clogging of a filter and nozzles in the spinneret is not generated, and thus a stable spinning of the fiber is obtained.

When a dope is prepared by using the 2,2-dichloro-1,1,1-trifluoroethane or the 1,2-dichloro-trifluoroethane, and the dope is extruded from the spinneret having a hole of the same size as that used for extruding a dope including a conventional solvent such as a trichlorofluoromethane, a volume extruded from the spinneret of the dope using either of the above two solvent in accordance with the present invention is about two times that obtained when using the conventional solvent. Accordingly, a high productivity in the fiber spinning process can be attained by using the dope in accordance with the present invention.

The ozone layer depletion potential of the 2,2-dichloro-1,1,1-trifluoroethane, the 1,2-dichlorotrifluoroethane and the dichloromethane are lower, and accordingly, the use of these three solvents is preferable for protection of the environment. In the present invention, it is possible to use a solvent blended the dichloromethane with the 2,2-dichloro-1,1,1-trifluoroethane or the 1,2-dichlorotrifluoroethane, and in this case, even if there are slight differences in a component, a molecular weight, or a concentration of the polymer, it is possible to maintain a temperature and a pressure used in the manufacturing process at a constant value by suitably selecting a blending ratio of the dichloromethane and another solvent. Accordingly it is possible to spin the fiber in accordance with the present invention without changing a specification of the spinning apparatus. This is practically useful when manufacturing the fiber in accordance with the present invention.

The polypropylene three-dimensional plexifilamentary fiber in accordance with the present invention can be stably spun by the manufacturing method in accordance with the present invention. When the 2,2-dichloro-1,1,1-trifluoroethane or the 1,2-dichlorotrifluoroethane is used as a main solvent, it is possible to increase a volume extruded from the spinneret and a solvent having a lower ozone layer depletion potential can be used in the manufacturing method in accordance with the present invention. Accordingly, the manufacturing method in accordance with the present invention is suitable for protecting the environment.

The present invention will now be described with reference to the following examples.

EXAMPLES 1 TO 3, AND COMPARATIVE EXAMPLES 1 AND 2

Various commercially available isotactic polypropylenes shown in Table 2 are degradated by the two following methods, to prepare isotactic polypropylenes able to be used as raw materials in the manufacture of the fibers in accordance with the present invention, and having a required MFR and $\overline{M}w/\overline{M}n$, respectively.

The polymer is degradated by applying a heating treatment to the isotactic polypropylene by an extruder, or by using a decomposer. Namely the isotactic polypropylene is supplemented with a 1,3-bis(t-butylisopropyl)benzene (Perkadox 14 supplied from Kayaku Akzo KK), which is an organic peroxide, and then supplied to the extruder.

The preparation of a dope and a flash spinning for manufacturing a fiber is performed by a spinning apparatus including a polymer solution blending and preparing zone in which an extruder having a single screw of 30 mmϕ, a solvent introducing zone, a mixing zone, a pressure let-down chamber and a spinneret are consecutively arranged. Namely, the above degradated isotactic polypropylene is supplied to the extruder to melt the polypropylene, and a trifluoromethane is introduced into the solvent introducing zone at a high pressure and constant pumping volume to obtain a homogeneous dope. This dope is extruded through the pressure let-down chamber and the spinneret, and the extruded fibers are impinged on a copper plate inclined by 45° to the extruded fibers at a position remote from the spinneret by about 20 mm, whereby spread three-dimensional plexifilamentary fibers are obtained.

An orifice arranged upstream of the pressure let-down chamber has a diameter of 0.5 mmϕ and a length of 5 mm, and an inner volume of the pressure let-down chamber is about 3 $cm^3$. The spinneret in which an angle of the stream introduced from the pressure let-down chamber to a nozzle hole is 60°, has nozzle having a diameter of 0.7 mmϕ and a length of 0.7 mm and is equipped with a circular groove arranged coaxially to an axis of the nozzle hole, on an outside of the nozzle hole, and having a diameter of 4.5 mmϕ and a depth of 3.9 mm, is used. A concentration of the polypropylene is between 8.8 wt % and 9.8 wt %, and a solution extruding volume is between 1367 g/min and 1388 g/min. A temperature of the solution in the mixing portion is between 202° C. and 203° C., and a pressure of the solution in the mixing zone is between 228 $kg/cm^2G$ and 272 $kg/cm^2G$. The above values differ slightly according to the polypropylene used as the raw materials.

The results are shown in Table 2.

It is apparent from the values of $\overline{M}w/\overline{M}n$ and MFR of the obtained fiber shown in Table 2 that the $\overline{M}w/\overline{M}n$ and MFR of the polypropylene in the dope are included in the range defined by the present invention.

When the $\overline{M}w/\overline{M}n$ value of the polypropylene used as the raw material is 4.8 or less (in this case, the MFR value is sufficiently small), the fiber in accordance with the present invention and having a microwave birefringence of 0.07 or more and an $\overline{M}w/\overline{M}n$ of 4.3 or less can be obtained from the various different grades of isotactic polypropylenes supplied from different makers. Further, it is apparent from Table 2 that the obtained fibers have a superior fiber spreadability, tensile strength, and thermal dimensional stability, respectively.

When polypropylenes having an $\overline{M}w/\overline{M}n$ of 4.8 or more are used as the raw materials, even if the MFR of the polypropylene has the same value as that of the polypropylene used in the examples, the spinning state in these cases becomes unstable, as shown in the comparative example 2.

In the comparative example 1, the microwave birefringence of the fiber is 0.07 or more and the MFR of the polypropylene in the dope is 20 or less. Nevertheless, the $\overline{M}w/\overline{M}n$ of the fiber is 4.3 or more and the fiber spreadability of the fiber is poor.

In the comparative example 2, the microwave birefringence and the $\overline{M}w/\overline{M}n$ of the obtained fiber are outside the range defined by the present invention, and thus have poor values for the fiber spreadability, the tensile strength, and the elongation under heating.

Note that a spread agent is not used for the examples 1 to 3 and the comparative examples 1 and 2.

TABLE 2

| | Polymer Grade (Supplier) | MFR of Polymer Before Degradation | Method of Degration a) | Polymer After Degradation And Used as Raw Material | | Stability in Spinning Operation b) |
|---|---|---|---|---|---|---|
| | | | | MFR | $\overline{M}w/\overline{M}n$ | |
| Example 1 | EP-BQ (Mitsui-Toatsu Kagaku) | 0.35 | P | 2.5 | 4.28 | ○ |
| Example 2 | E1000 (Asahi Kasei) | 0.50 | P | 2.6 | 4.35 | ○ |
| Example 3 | K1011 (Chiso) | 0.83 | H | 2.8 | 4.31 | ○ |
| Comparative | K1014 | 3.5 | — | 3.5 | 6.02 | Δ |

TABLE 2-continued

| | | | | | | | | | | |
|---|---|---|---|---|---|---|---|---|---|---|
| Example 1 | (Chiso) | | | | | | | | | |
| Comparative Example 2 | E1200 (Asahi Kasei) | | | 1.9 | H | 2.5 | 7.03 | | x | |
| | Characteristics of Fiber | | | | | | | | | |
| | | | | | | | Tensile Strength (g/d) | | Elongation under heating c) (%) | |
| | MFR | $\overline{M}w/\overline{M}n$ | Microwave Birefringence c) | Number 3 of free fibrils | Fiber Width (mm) | Fineness (Spread Fiber) | Before Spreading | Spread Fiber | 100° C. | 130° C. |
| Example 1 | 5.1 | 3.94 | 0.116 | 207 | 31 | 128 | 4.4 | 3.8 | 3.0 | 4.5 |
| Example 2 | 7.7 | 3.61 | 0.107 | 382 | 31 | 113 | 3.8 | 3.7 | 3.1 | 5.2 |
| Example 3 | 8.1 | 3.94 | 0.114 | 309 | 27 | 117 | 4.3 | 3.8 | 2.6 | 4.3 |
| Comparative Example 1 | 10.4 | 5.17 | 0.073 | 146 | 21 | 112 | 2.1 | 2.2 | 7.5 | 12.1 |
| Comparative Example 2 | 7.0 | 6.12 | 0.041 | — d) | — d) | — d) | 0.9 | — d) | 9.8 | 14.6 |

a) P: Perkadox 14 (Decomposer) used, H: Degradated by Heating
b) o: Stable, Δ: Slightly Unstable, x: Unstable
c) Fiber before Applying Spreading Operation measured in Comparative Example 2, Fibers applied with Spreading Operation measured in other Examples.
d) Measurement: Unsuccessful

EXAMPLE 4

An isotactic polypropylene (E1100 supplied by Asahi Kasei Kogyo Kabushiki Kaisha) having MFR of 0.50 is degradated by Perkadox 14 to prepare the isotactic polypropylene able to be used as a raw material when manufacturing the fiber in Example 4, and having an MFR of 5.4 and an $\overline{M}w/\overline{M}n$ of 4.46.

The preparation of a dope and the flash spinning thereof in Example 4 is performed by using the same solvent and apparatus as used in Examples 1 to 3 and Comparative Examples 1 and 2, except that a concentration of the polypropylene is 12%.

The results are shown in Table 3.

The MFR of the spread fiber in Example 4 is 15.3, which is within the preferable range of the present invention. Accordingly, the spread fiber in Example 4 has a high tensile strength and lower elongation under heating.

When the degradated isotactic polypropylenes having an MFR of 7 or less and an $\overline{M}w/\overline{M}n$ of 4.8 or less are used, polypropylene three-dimensional plexifilamentary fibers having a superior fiber spreadability and high tensile strength are obtained. It is apparent from Table 4 that, when the fiber has a microwave birefringence of 0.07 or more and an $\overline{M}w/\overline{M}n$ of 4.3 or less, a fiber spreadability of a tensile strength of the fiber is superior.

In Comparative Example 4, the MFR of the polypropylene used as the raw material is 7 or less, but the $\overline{M}w/\overline{M}n$ of the polypropylene used as the raw material is bigger than 4.8 and the $\overline{M}w/\overline{M}n$ of the polypropylene in the dope is bigger than 4.3. Accordingly, the fiber in Comparative Example 3 has an inferior fiber spreadability, small microwave birefringence, and lower tensile strength.

In Comparative Example 4, the MFR of the polypropylene used as the raw material is 7 or less, but the $\overline{M}w/\overline{M}n$ of the polypropylene used as the raw material is bigger than 4.8 and the $\overline{M}w/\overline{M}n$ of the polypropylene in the dope is bigger than 4.3. Accordingly the fiber in Comparative Example 4 has a microwave birefringence of 0.07 or more, and a relatively high tensile strength, but the fiber spreadability thereof is poor and it is impossible to manufacture a web used for a nonwoven fabric and having a uniform thickness and a superior appearance from this fiber, due to the inferior fiber spreadability.

In Comparative Example 5, the MFR of the polypropylene used as the raw material is 7 or more, and accordingly, the fiber in Comparative Example 5 has a small microwave birefringence and lower tensile strength.

Webs are manufactured from the fiber in Examples 5–10 by spreading and dispersing the fiber by a rotary

TABLE 3

| | | | Polymer After Degradation And Used as Raw Material | | Characteristics of Spread Fiber | | | | | |
|---|---|---|---|---|---|---|---|---|---|---|
| | Polymer grade | Decomposer | MFR | $\overline{M}w/\overline{M}n$ | MFR | $\overline{M}w/\overline{M}n$ | Microwave Birefringence | Fiber Spreadability a) | Tensile Strength (g/d) | Elongation Under Heating 100° C. (%) |
| Example 4 | E1100 | Peroxide | 5.4 | 4.46 | 15.3 | 3.60 | 0.115 | o | 3.4 | 3.8 |

a) Visual Evaluation.
o: Good,
Δ: Slightly Inferior,
x: Inferior

EXAMPLES 5 TO 10 AND COMPARATIVE EXAMPLES 3 TO 5

Various commercially available isotactic polypropylenes shown in Table 4 having a typical high molecular weight are degradated by the same methods used in Examples 1 to 3, to prepare the isotactic polypropylene able to be used as a raw material for the manufacture of fibers, in Examples 5 to 10 and Comparative Examples 3 to 5, and having a required MFR and $\overline{M}w/\overline{M}n$, respectively.

The preparation of a dope and the flash spinning in Examples 5 to 10 and Comparative Examples 3 to 5 are performed by using the same solvent and apparatus as used in Examples 1 to 3.

The results are shown in Table 4.

impingement member having three fiber dispersing faces, piling the spread fibers on a running net, and slightly pressing the spread fibers on the running net by a roll. The nonwoven fabrics are manufactured by heat-bonding the webs in Examples 5–10 by a felt calender. The obtained nonwoven fabrics have a superior uniformity in the thickness thereof and a high mechanical strength. For example, the nonwoven fabric manufactured from the fibers in Example 7 and having a weight per unit area of 60 g/m$^2$ has the following mechanical properties.

| | |
|---|---|
| Tensile Strength | |
| Lengthwise Direction | 11.0 kg/3 cm |
| Transverse Direction | 12.2 kg/3 cm |
| Elmendorf Tear Strength | |
| Lengthwise Direction | 0.14 kg |
| Transverse Direction | 0.15 kg |

ranged on the bottom of the autoclave is opened to exhaust the solution through a pressure let-down orifice having a diameter of 0.65 mm and length of 5 mm, into a pressure let-down chamber having a diameter of 8 mm and length of 40 mm. The solution is then introduced into a spinneret having the following specification, and extruded into the atmosphere.

An angle of introducing the solution from the pressure let-down chamber to

| | |
|---|---|
| an nozzle hole of the spinneret: | 60° |
| Nozzle hole | |
| diameter: | 0.5 mm |
| length: | 0.5 mm |
| Circular groove having the same center of that of the nozzle hole | |
| diameter: | 3.0 mmϕ |
| depth: | 3 mm |

TABLE 4

| | Polymer Grade | Method of Degradation a) | Polymer After Degradation and Used as Raw Material MFR | Polymer After Degradation and Used as Raw Material $\overline{M}w/\overline{M}n$ | Characteristics of Fiber $\overline{M}w/\overline{M}n$ | Microwave Birefringence of Spread Fiber | Fiber Spreadability b) | Tensile Strength Before Spreading (g/d) | Tensile Strength of Spread Fiber (g/d) |
|---|---|---|---|---|---|---|---|---|---|
| Example 5 | K1011 | P | 2.63 | 4.65 | 3.72 | 0.082 | ∘ | 3.0 | 2.5 |
| Example 6 | K1011 | H | 2.85 | 4.24 | 3.69 | 0.088 | ∘ | 3.4 | 2.9 |
| Example 7 | E1100 | P | 2.63 | 4.47 | 4.13 | 0.095 | ∘ | 3.9 | 3.3 |
| Example 8 | E1100 | P | 3.00 | 3.88 | 3.69 | 0.105 | ∘ | 3.8 | 3.8 |
| Example 9 | E1100 | P | 5.46 | 3.71 | 3.37 | 0.113 | ∘ | 4.1 | 3.8 |
| Example 10 | E1100 | H | 3.40 | 3.80 | 3.64 | 0.086 | ∘ | 3.9 | 3.2 |
| Compartive Example 3 | K1011 | H | 2.70 | 4.94 | 4.44 | 0.049 | x | 2.0 | 1.11 |
| Comparative Example 4 | EP-BQ | H | 2.54 | 5.34 | 4.86 | 0.074 | Δ-x | 3.8 | 2.1 |
| Comparative Example 5 | K1011 | p | 8.10 | — | — | 0.067 | ∘ | 2.4 | 1.9 |

a) P: Perkadox 14 (Decomposer) used, H: Degraded by Heating
b) Visual Evaluation o: Good, Δ: Slightly Inferior, x: Inferior

EXAMPLES 11 AND 12

The polypropylene solutions in Examples 11 and 12 are prepared by an autoclave. Namely, 64.1 g of an isotactic polypropylene having an MFR of 1.3 and 546 g of a 2,2-dichloro-1,1,1-trifluoroethane (in Example 11) or 1,2-dichloro-trifluoroethane (in Example 12) are fed into the autoclave so that a concentration of the polypropylene becomes 10.5 wt %. The autoclave is heated with a rotation of a propeller type stirring machine to dissolve the polypropylene in the solvent. The solution is further heated, and thus a pressure of the solution is raised to completely dissolve the polypropylene. After completing the dissolution of the polypropylene, the solution is partially exhausted from a nozzle arranged on a bottom of the autoclave, so that the pressure of the solution does not exceed 300 kg/cm$^2$G, which is a design pressure of the autoclave, and thus the pressure of the solution is kept between 200 kg/cm$^2$G and 300 kg/cm$^2$G. When the temperature of the solution becomes 215° C., the solution is exhausted so that the pressure of the solution is kept at a pressure lower than the pressure used in the spinning process by 10 kg/cm$^2$G. When the temperature of the solution becomes again at 215° C., the stirring machine is stopped, $N_2$ gas is introduced from an $N_2$ gas introducing valve arranged on an upper portion of the autoclave, to maintain the pressure of the solution at the predetermined value, and simultaneously, an exhausting valve ar- The extruded fiber is spread by a plate of a vinyl chloride inclined by 45° to the extruded fibers at a position remote from the spinneret by about 20 mm, and the spread fiber is collected on a metal wire net of 10 mesh.

The main spinning conditions and characteristics of the obtained fiber are shown in Table 5.

It is apparent that the $\overline{M}w/\overline{M}n$ and MFR of the polypropylene in the dopes one within the range defined by the present invention, from the value of $\overline{M}w/\overline{M}n$ and MFR of the fibers shown in Table 5. Further, the microwave birefringence, $\overline{M}w/\overline{M}n$, and MFR of the fibers in Example 11 and 12 are also with in the range defined by the present invention, and thus a polypropylene three-dimensional plexifilamentary fiber having a superior spreadability and high tensile strength is obtained.

TABLE 5

| | Example 11 2,2-dichloro-1,1,1-trifluoroethane | Example 12 1,2-dichloro-trifluoroethane |
|---|---|---|
| Concentration of Polymer (wt %) | 10.5 | 10.5 |
| Heating Time (min) | 65 | 59 |
| Solution | | |
| Temperature (°C.) | 215 | 215 |
| Pressure (kg/cm$^2$G) | 178 | 170 |
| Pressure in Pressure | 136 | 129 |

TABLE 5-continued

| | Example 11 2,2-dichloro-1,1,1-trifluoroethane | | Example 12 1,2-dichloro-trifluoroethane | |
|---|---|---|---|---|
| Let-down Chamber ($kg/cm^2G$) | | | | |
| Characteristics of Fiber | | | | |
| Type of Fibers | Fiber Before Spreading | Spread Fiber | Fiber Before Spreading | Spread Fiber |
| Fiber Spreadability a) | — | o | — | o |
| Fineness (d) | 107 | 125 | 75 | 102 |
| Tensile Strength (g/d) | 3.6 | 4.3 | 3.4 | 3.8 |
| Elongation (%) | 42 | 54 | 62 | 67 |
| Specific Surface Area ($m^2/g$) | 7.7 | | 8.5 | |
| Microwave Birefringence | | 0.120 | | 0.109 |
| Mw/Mn | 4.0 | | 3.8 | |
| MFR | 4.3 | | 7.6 | |

a) Visual Evaluation o: Good

EXAMPLES 13 TO 15

An isotactic polypropylene (E1100 supplied by Asahi Kasei Kogyo Kabushiki Kaisha) having MFR of 0.50 is degradated by Perkadox 14 to prepare an isotactic polypropylene able to be used as a raw material when manufacturing the fibers in Examples 13 to 15, and having predetermined MFR and $\overline{M}w/\overline{M}n$ values, respectively.

The preparation of the dopes and the flash spinning thereof in Examples 13 to 15 are performed by the same apparatus as that used in Examples 1 to 3, and by using 2,2-dichloro-1,1,1-trifluoroethane or 1,2-dichlorotrifluoroethane.

The main spinning conditions and characteristics of the obtained fibers are shown in Table 6.

It is apparent that the dope having the characteristics within the range defined by the present invention can be prepared by the raw material of the polypropylene within the range defined by the present invention, from Table 6, and as a result, a fiber having a superior fiber spreadability and high tensile strength can be obtained.

When the 2,2-dichloro-1,1,1-trifluoroethane is used as the solvent, the extruding volume of the solution per a cross section of the spinning nozzle hole becomes twice that where trichlorofluoromethane is used as the solvent, by suitably selecting the spinning condition.

The fiber in Example 15 is spread, dispersed and piled one on the other by the same method as that used in Example 7, to make a web. The obtained web has a uniform thickness and a superior appearance.

TABLE 6

| | Example 13 | 14 | 15 |
|---|---|---|---|
| Solvent a) | TCFM | DCTFE | DCTFE |
| Polymer Used as Raw Material | | | |
| MFR | 3.5 | 3.6 | 3.8 |
| Mw/Mn | 4.4 | 4.3 | 4.2 |
| Concentration of Polymer (wt %) | 10.6 | 10.3 | 10.3 |
| Extruding Volume (g/min) | | | |
| Solution | 2153 | 2332 | 2276 |
| Polymer | 228 | 240 | 234 |
| Condition in Position Where Polymer is dissolved | | | |
| Temperature (°C.) | 229 | 225 | 227 |
| Pressure ($kg/cm^2G$) | 200 | 173 | 164 |
| Condition in Pressure Let-down Chamber | | | |
| Temperature (°C.) | 195 | 210 | 209 |
| Pressure ($kg/cm^2G$) | 54 | 96 | 108 |
| Dimension of Spinning Head | | | |
| Pressure Let-down Orifice | | | |
| Diameter (mm) | 0.70 | 0.85 | 0.85 |
| Length (mm) | 5.0 | 5.0 | 5.0 |
| Spinning Nozzle Hole | | | |
| Diameter (mm) | 0.95 | 0.70 | 0.70 |
| Length (mm) | 0.95 | 0.70 | 0.70 |
| Groove of Nozzle | | | |
| Diameter (mm) | 6.4 | 4.7 | 4.7 |
| Length (mm) | 5.3 | 4.1 | 4.1 |
| Extruding Volume at Spinning Nozzle Hole ($g/Sec \cdot mm^2$) | | | |
| Solution | 50.6 | 101 | 98.6 |
| Polymer | 5.4 | 10.4 | 10.1 |
| Fiber Spreadability b) | o | o | o |
| Characteristics of Spread Fiber | | | |
| MFR | 7.3 | 3.8 | 4.6 |
| M/Mn | 3.9 | 4.2 | 4.1 |
| Microwave Birefringence | 0.093 | 0.104 | 0.095 |
| Fineness (d) | 184 | 181 | 201 |
| Tensile Strength (g/d) | 3.0 | 3.9 | 3.2 |
| Specific Surface Area ($m^2/g$) | 10 | 11 | 11 |

a) TCFM: trichlorofluoromethane,
DCTFE: 2,2-dichloro-1,1,1-trifluoroethane
b) Visual Evaluation o: Good

EXAMPLE 16

A polypropylene solution in Example 16 is prepared by an autoclave. Namely 64.1 g of an isotactic polypropylene having MFR of 1.3 and 546 g of a blended solvent composed of a dichloromethane of 38.5 wt % and a 2,2-dichloro-1,1,1-trifluoroethane of 61.5 wt % are fed into the autoclave so that a concentration of the polypropylene becomes 10.5 wt %. The autoclave is heated with a rotation of a propeller type stirring machine to dissolve the polypropylene in the solvent. The solution is further heated, and thus a pressure of the solution is raised to completely dissolve the polypropylene. After completing the dissolution of the polypropylene, the solution is partially exhausted from a nozzle arranged on a bottom of the autoclave so that the pressure of the solution does not exceed 300 $kg/cm^2G$, which is a design pressure of the autoclave, and thus the pressure of the solution is kept between 200 $kg/cm^2G$ and 300 $kg/cm^3G$. When the temperature of the solution becomes 215° C. after heating for 53 min, the solution is exhausted so that the pressure of the solution is kept at a pressure lower than the pressure, i.e., 100 $kg/cm^2G$ used at spinning process by 10 $kg/cm^2G$. When the temperature of the solution becomes again at 215° C., the stirring machine is stopped, $N_2$ gas is introduced from a $N_2$ gas introducing valve arranged on an upper portion of the autoclave, to keep the pressure of the solution at the pressure of 100 $kg/cm^2G$, and simultaneously, an exhausting valve arranged on the bottom of the autoclave is opened to exhaust the solution through a pressure let-down orifice having a diameter of 0.65 mm and length of 5 mm, into a pressure let-down chamber having a diameter of 8 mm and length of 40 mm. Then the solution is introduced into a spinneret having the following specification, and extruded into the atmosphere.

An angle of introducing the solution from the pressure let-down chamber to

| | |
|---|---|
| a nozzle hole of the spinneret: | 60° |
| Nozzle Hole | |
| diameter: | 0.5 mm |
| length: | 0.5 mm |
| Circular groove having the same center of that of the nozzle hole | |
| diameter: | 3.0 mmϕ |
| depth: | 3 mm |

The extruded fiber is spread by a plate of a vinyl chloride inclined by 45° to the extruded fibers at a position remote from the spinneret by about 20 mm, and the spread fiber is collected on a metal wire net of 10 mesh. In this case, the pressure of the pressure let-down chamber is 77 kg/cm$^2$G.

The fiber before applying the spreading operation has a fineness of 72d, tensile strength of 3.9 g/d, elongation of 47% MFR of 4.5, and $\overline{M}w/\overline{M}n$ of 4.1, and the spread fiber has a fineness of 81 d, tensile strength of 4.0 g/d, elongation of 55%, microwave birefringence of 0.101, and specific surface area of 12.7 m$^2$/g. Thus, the polypropylene three-dimensional plexifilamentary fiber having a superior configuration can be obtained.

EXAMPLE 17

A polypropylene solution in Example 17 is also prepared by the autoclave. Namely 64.1 g of an isotactic polypropylene having an MFR of 1.3 and 546 g of a blended solvent composed of a dichloromethane of 33 wt % and a 1.2-dichloro-trifluoroethane of 67 wt % are supplied into the autoclave so that a concentration of the polypropylene becomes 10.5 wt %. A dope is prepared under a high temperature and a high pressure and a fiber is spun and spread by the same operations as used in Example 16, except that the pressure of the solution is 103 kg/cm$^2$G and the pressure in the pressure let-down chamber is 85 kg/cm$^2$G.

The spread fiber has a fineness of 68 d, tensile strength of 4.3 g/d, fiber width of 25 mm, microwave birefringence of 0.115, $\overline{M}w/\overline{M}n$ of 3.6, MFR of 5.5, and specific surface area of 12.7 m$^2$/g. Thus, a highly spread polypropylene three-dimensional plexifilamentary fiber having a superior configuration can be obtained.

We claim:

1. A polypropylene fibrillated three-dimensional plexifilamentary fiber of an isotactic polypropylene, wherein said fiber has a microwave birefringence of 0.07 or more, a Mw/Mn of 4.3 or less, and a MFR of from 3.5 to 10.

* * * * *